United States Patent [19]

Oda et al.

[11] 4,306,917

[45] Dec. 22, 1981

[54] CONVERSION COATING SOLUTIONS FOR TREATING METALLIC SURFACES

[75] Inventors: Nobuyuki Oda, Yokohama; Haruyoshi Terada, Tanashi, both of Japan

[73] Assignee: Nihon Parkerizing Co., Ltd., Japan

[21] Appl. No.: 217,233

[22] Filed: Dec. 17, 1980

[30] Foreign Application Priority Data

Dec. 29, 1979 [JP] Japan ..... 54/172060

[51] Int. Cl.[3] ..... C23F 7/08

[52] U.S. Cl. ..... 148/6.15 R; 148/6.17

[58] Field of Search ..... 148/6.15 R, 6.17

[56] References Cited

U.S. PATENT DOCUMENTS

| | | | |
|---|---|---|---|
| 2,490,062 | 12/1949 | Jernstedt | 148/6.15 R |
| 2,873,196 | 2/1959 | Baevsky | 148/6.15 R |
| 3,076,733 | 2/1963 | Otto | 148/6.15 R |
| 4,220,486 | 9/1980 | Matsushima et al. | 148/6.15 R |

*Primary Examiner*—Ralph S. Kendall

*Attorney, Agent, or Firm*—Ostrolenk, Faber, Gerb & Soffen

[57] ABSTRACT

A conversion coating solution for treating metallic surfaces has a pH value in the range of 3 to 6 and contains 1 g/l to 50 g/l of an acid alkali phosphate as phosphate ions, 0.2 g/l to 20 g/l of one or more of chlorates and bromates, and 0.01 g/l to 0.5 g/l of tin ions, with a weight ratio of chlorine ions to tin ions being between 0.6 and 6. The solution provides a continuous and uniform conversion coating having high anti-corrosion performance.

9 Claims, No Drawings

CONVERSION COATING SOLUTIONS FOR TREATING METALLIC SURFACES

BACKGROUND OF THE INVENTION

The present invention relates to a conversion coating solution for treating metallic surfaces such as steel, galvanized steel sheets, tin-plated steel sheets and the like, particularly exposed steel surfaces treated by subjecting tin-plated steel sheets to drawing and ironing (hereinafter referred to as "DI processing"), for example, metallic surfaces such as tin-plated DI cans.

The surface treatment of metallic surfaces, particularly tin-plated DI cans, has heretofore used a solution for forming a passive chromate coating or a conversion coating solution containing an alkali phosphate as a main component. The former solution is used to form a passive chromate coating usually by rinsing the tin-plated DI can surfaces with a weak alkaline degreasing agent and then treating them with a treating solution containing chromic acid or a salt thereof. The coating or film can provide an anticorrosive property and can contribute to an increase in durability of the coating as an anticorrosive ground coat.

Chromium compounds contained in the treating solutions, however, present problems with respect to the environment when they are contained in waste water from a plant. They are also undesirable for use in processing of containers for food such as cans for food and drink because of their high toxicity.

The latter conversion coating solution containing an alkali phosphate as the main component contains acid alkali phosphates such as, sodium phosphate, potassium phosphate, ammonium phosphate or the like, and further contains an oxidizing agent such as $NaClO_3$, $NaBrO_3$, $NaNO_2$, hydroxylamine salt or the like, or an additive of a halogen compound such as a fluoride as an agent for accelerating the formation of a film or coating.

Coatings or films obtainable by treating tin-plated DI can surfaces with the conversion coating solution as stated hereinabove can provide good adhesion of paints and a favorable gloss on the coated surfaces, but present the drawback of poor anti-corrosive performance because of the small amount of coating formed. In particular, tin-plated DI cans are exposed to the workshop atmosphere during the steps of rinsing with water, drying, over coating and printing after the conversion coating treatment step, so that rust is formed during these steps because coatings or films obtainable from conventional alkali phosphate coating solutions provide poor anti-corrosiveness; accordingly, the conventional technique has the defect of losing, after coating, the substantial effect produced by the conversion treatment.

Prior art solutions for treating metallic surfaces which contain tin ions are disclosed, for example, in Japanese Patent Publication No. 6,848/1971 (counterpart of U.K. Patent Specification No. 1,247,082), W. German Patent Publication (DE-AS) No. 1,199,100, and Japanese Laid-Open Patent Application No. 62,179/1980 (counterpart of U.S. Pat. No. 4,220,486).

Japanese Patent Publication No. 6,848/1971 involves conversion coating solutions for forming oxalate films on stainless steel and a process for treating the same. In this technique, the effect of the $Sn^{++}$ action resides in the acceleration of etching on the stainless steel and forming an oxalate conversion coating thereon. When this treating solution is applied to tin-plated DI cans or tin-plated steel sheets, however, an oxalate coating having no gloss is formed with the treated surfaces, and no anticorrosive tin phosphate coating is formed thereon.

W. German Patent Publication No. 1,199,100 discloses conversion coating solutions for treating zirconium and its alloys and a process for forming coatings or films thereon. When these conversion coating solutions are applied to tin-plated cans or tin-plated steel sheets, the tin in the metallic surfaces to be treated is dissolved to a great extent, thereby reducing the gloss on the tin-plated surfaces and losing the function of the tin plating. When they are applied to steel sheets, only films in a form of smut are formed, and no coating or film with superior anticorrosive performance and adhesion of paints can be obtained. This prior art technique treats Mo as an equivalent of Sn and includes a film forming accelerator in each case. However, when the conversion coating solution containing Mo is applied to steel sheets or tin-plated steel sheets, no coating or film having good adhesion with an overcoat can be obtained.

Japanese Laid-Open Patent Application No. 62,179/1980 discloses conversion coating solutions which have a pH value in the range of 5.5 to 6.5 and contain 0.01 g/l to 0.5 g/l of stannous ions with respect to an acid alkali phosphate, and 2 to 12 parts of fluorine ions with respect to the stannous ion amount. As these solutions contain fluorine, measures should be taken to remove the fluorine from waste liquids from plants for conversion treatment from the standpoint of environmental protection. Several techniques for removing fluorine from waste liquids are known such as adsorption of the fluorine on active alumina, but the cost for treating waste liquids according to these techniques is high. As the fluorine is used to stabilize the stannous ions by forming a complex, excess fluorine is necessary. Accordingly, where tin-plated steel sheets or tin-plated DI cans are treated with such a conversion coating solution, the amount of etching of the tin surfaces is so large that the anti-corrosiveness of the tin formed on the treated metallic surfaces is weakened.

SUMMARY OF THE INVENTION

Therefore, an object of the present invention is to provide a conversion coating solution which can overcome the disadvantages and defects as presented hereinabove with respect to the prior art conversion coating solutions, and which can form a continous and uniform conversion coating or film having high anti-corrosion performance, extremely fine texture, favorable adhesion with an overcoat to be formed in a succeeding step, an anti-corrosion and gloss on the overcoat and is stable in forming such a conversion coating or film and which can produce metallic surfaces containing no hazardous chrome ions and fluorine ions.

In order to achieve the objects as stated hereinabove, the present invention provides a conversion coating solution for treating metallic surfaces which has a pH value in the range of 3 to 6 and which contains 1 g/l to 50 g/l of an acid alkali phosphate as phosphate ions, 0.2 g/l to 20 g/l of one or more of chlorates and bromates, and 0.01 g/l to 0.5 g/l of tin ions, with a weight ratio of chlorine ions to tin ions the range of 0.6 to 6, tin and chlorine being present in the form of complex ions so that the solution is stable and both the tin and the chlorine are present in a stable state. When desired, a surfactant may be added to the conversion coating solutions according to the present invention in order to simultaneously effect degreasing and the conversion treatment.

The treatment on the metallic surfaces with the conversion coating solutions can form a continuous and uniform coating containing insoluble tin phosphate. The conversion coating is secure in its linkage with the substrate and superior in anti-corrosiveness. In addition, it has favorable adhesion with an overcoat which is formed in a subsequent step with a favorable anti-corrosiveness and gloss. The coating or film obtainable by the treatment of metallic surfaces, particularly steel surfaces, with the conversion coating solutions according to the present invention also can provide superior performance as a lubricating film for plastic deformation processing in the steps which follow.

DETAILED DESCRIPTION OF THE PREFERRED EMBODIMENTS

The conversion coating solutions according to the present invention will be described below in more detail. The acid alkali phosphates to be used may include sodium, potassium and ammonium salts of phosphate as well as phosphoric acid neutralized with caustic alkali, aqueous ammonia or the like. It is desirable that these alkali phosphates be present in the conversion coating solution as phosphate ions in an amount of 1 g/l to 50 g/l. Where the acid alkali phosphates are present as phosphate ions in the amount of 5 to 25 g/l, phosphate coatings having superior anti-corrosiveness can be formed.

As a source of tin ions, there may be used stannous chloride, stannic chloride, stannous sulfate, sodium stannate and the like. The concentration of the tin ions is preferably in the range of 0.01 g/l to 0.5 g/l. Where the concentration is below 0.01 g/l, a coating with poor anti-corrosiveness is produced. Where the concentration of the tin ions is over 0.5 g/l, the conversion coating solutions become unstable and cannot achieve better anti-corrosiveness.

The chlorine ions may come from hydrochloric acid or alkali chlorine compounds such as sodium chloride, potassium chloride, ammonium chloride and the like; tin chloride may also be used. The weight ratio of the chlorine ions to the tin ions is preferably in the range of 0.6 to 6. Where the weight ratio of the chlorine ions is below 0.6, insoluble tin phosphates precipitate in the conversion coating solutions, and sludges are formed so that such a solution is not preferred. Where the weight ratio is over 6, the metal to undergo the conversion treatment is dissolved to an increasing extent, so that the effect of the formation of tin phosphate coatings or films is reduced.

The pH values of the conversion coating solutions according to the present invention for providing a superior and close coating or film is preferably in the range of 3 to 6. When the pH value is higher than 6, it is not preferred as insoluble tin hydroxide is formed in the conversion coating solutions. When the pH value is 2.9 or below, it is not preferred because the anti-corrosive effect is reduced. The pH values of the conversion coating solutions may be adjusted to a desired level by a caustic alkali such as caustic soda or the like, or by an acid such as phosphoric acid, hydrochloric acid, sulfuric acid or the like.

The process for conversion-treating metallic surfaces, particularly cans obtained by the DI processing of tin-plated steel plates with the conversion coating solutions according to the present invention having the composition and the adjusted pH value as mentioned hereinabove, will be described hereinbelow in greater detail.

Metallic products to be treated are first rinsed with a weak alkaline degreasing agent and sprayed with or immersed in the conversion coating solution. The conversion-treated metal surfaces are washed with water and then dried in hot air at 50°–220° C. The temperature for the conversion treatment in this case may be room temperature, but treatment at elevated temperatures in the range of 40°–90° C. can provide a coating or film having superior anti-corrosion in addition to accelerating the conversion reaction. The duration for which the metallic products to be treated are in contact with the treating solution is appropriately in the range of 10 to 120 seconds. The coating or film thus prepared may be subjected to a following step of overcoating or printing.

The rinsed metal, particularly tin-plated steel sheet, may be subjected to cathode electrolysis or alternating current electrolysis by using it as the negative electrode and using a carbon plate or a stainless steel plate or the like as the positive electrode, with a distance of 10 mm to 500 mm between the electrodes and an electric current density of 0.1 A/dm$^2$ over a period of 0.5 to 60 seconds. The electrolysis may be used in combination with the conversion treatment as desired. The metal thus treated is rinsed with water and dried in hot air at 50° to 220° C. to form a coating having superior anti-corrosiveness.

As described hereinabove, since the conversion coating solutions for treating metallic surfaces in accordance with the present invention comprise phosphate ions, tin ions, chlorine ions and chlorates and/or bromates, have a pH value in the range of 3 to 6, and form less sludge without containing any noxious metal such as chromium or fluorine, they are extremely advantageous with respect to measures to be taken against environmental polution. They are also advantageous in that operations in the conversion treatment can be carried out in a continuous and stable manner because each of the components is dissolved in the state of ions. In particular, the chlorine ions are present with the tin ions in the state of complex ions, thereby being maintained in a stable state and forming a conversion coating having superior anti-corrosiveness. Since the pH value in the conversion coating solution is restricted to the determined range, the corrosion of the metal surfaces and the elution of the metal therefrom by the conversion reaction are extremely small. Thus phosphate coatings or films containing insoluble tin phosphate as the main component and having close textures are obtained without corroding or dissolving out the metal from the plating layers on the metallic surfaces in the case of treatment of thinly tin-plated steel sheets, whereby the superior conversion effect is achieved.

The phosphate coatings or films thus formed can provide remarkably improved anti-corrosion performance, and produce no rust even when they are left exposed for long periods of time in a factory after the washing and drying steps which follow the conversion treatment step. The conversion coatings or films also show superior performance with respect to anti-corrosion, adhesion and gloss as ground coats for printing or further coating with, for example, organic thin coatings or films such as lacquers.

EXAMPLE 1

DI cans prepared by DI processing tin-plated steel sheets were rinsed with a 1% hot aqueous solution of a weak alkaline degreasing agent (Trademark: Fine Cleaner-4361A; manufactured by Nihon Parkerizing Co., Ltd.). After rinsing, the conversion coating treatment was carried out by spraying the following Conversion Coating Solution onto the cans for 20 seconds. The cans were then washed with city water, sprayed with deionized water of above 300,000 Ωcm specific resistance for 10 seconds, and dried in hot air at 200° C. for 30 minutes. The conversion-treated cans were tested for anti-corrosiveness by immersing them in city water at 60° C. for 30 minutes. The results were found to be good in comparison with Comparative Example 1, as shown in Table 1 below.

| Conversion Coating Solution | |
|---|---|
| 75% $H_3PO_4$ | 15 g/l |
| $SnCl_2 . 2H_2O$ | 0.3 g/l |
| NaCl | 0.1 g/l |
| $NaClO_3$ | 9 g/l |
| pH 3.5 | adjusted by NaOH aqueous solution |
| Temperature of Solution: 75° C. | |

EXAMPLE 2

Thin-plated DI cans were subjected to conversion treatment with the following Conversion Coating Solution in the same manner as in Example 1 and tested for anti-corrosiveness.

| Conversion Coating Solution: | |
|---|---|
| $NaH_2PO_4$ | 20 g/l |
| $NaBrO_3$ | 1 g/l |
| 35% HCl | 1 g/l |
| $SnSO_4$ | 0.2 g/l |
| pH 4.0 | adjusted by NaOH aqueous solution |
| Temperature of Solution: 55° C. | |

The treated cans indicated good anti-corrosive performance as shown in Table 1 below.

EXAMPLE 3

| Conversion Coating Solution: | |
|---|---|
| $Na_2HPO_4 . 12H_2O$ | 40 g/l |
| NaCl | 0.2 g/l |
| $SnCl_2 . 2H_2O$ | 0.3 g/l |
| $NaClO_3$ | 5 g/l |
| $KBrO_3$ | 0.5 g/l |
| pH 4.5 | adjusted by 75% solution of $H_3PO_4$ |
| Temperature of Solution: 60° C. | |

Tin-plated DI cans were subjected to conversion treatment with the above-mentioned Conversion Coating Solution in the same manner as in Example 1 and tested for anti-corrosiveness. The results indicated good anti-corrosiveness, as shown in Table 1 below.

COMPARATIVE EXAMPLE 1

| Comparative Conversion Coating Solution: | |
|---|---|
| 75% $H_3PO_4$ | 15 g/l |
| $NaClO_3$ | 9 g/l |
| $NaNO_3$ | 1 g/l |
| pH 4.5 | adjusted with NaOH |
| Temperature of Solution: 70° C. | |

COMPARATIVE EXAMPLE 2

| Comparative Conversion Coating Solution (Japanese Patent Publication No. 25,296/1978): | |
|---|---|
| $NaH_2PO_4$ | 5.3 g/l |
| $Na_2HPO_4$ | 4.7 g/l |
| $(NH_2OH)_2H_2SO_4$ | 1.2 g/l |
| $NH_4F . HF$ | 0.6 g/l |
| pH 5.3 | adjusted with NaOH |
| Temperature of Solution: 55° C. | |

COMPARATIVE EXAMPLE 3

| Comparative Conversion Coating Solution: | |
|---|---|
| 75% $H_3PO_4$ | 15 g/l |
| $SnCl_2 . 2H_2O$ | 0.1 g/l |
| NaCl | 3 g/l |
| $NaClO_3$ | 9 g/l |
| pH 3.5 | adjusted by NaOH aqueous solution |
| Temperature of Solution: 70° C. | |

TABLE 1

| | Results of Anti-corrosion Test | | | | | |
|---|---|---|---|---|---|---|
| | Examples | | | Comparative Examples | | |
| | 1 | 2 | 3 | 1 | 2 | 3 |
| Percentage of Rust Formation (%) | less than 5% | less than 10% | less than 10% | 100% | more than 90% | more than 60% |

EXAMPLE 4

Tin-plated DI cans which had previously been subjected to conversion treatment with the following Conversion Coating Solution were coated with an epoxy-urea type paint so as to have a coating thickness of 5 to 7 μm. The coatings were baked at 210° C. for 10 minutes and then allowed to stand for 24 hours, followed by immersion in a 1% citric acid aqueous solution at 95°-97° C. for 60 minutes. The coatings were then washed with water and dried.

The coatings were tested for peel strength according to the following method; a cross was cut in each coating with a sharp knife down to the metal substrate, adhesive tape was pressed thereon under strong pressure, and then the tape was rapidly peeled off. As a result, it was found that the coatings thus formed exhibit favorable adhesion with an overcoat because they were not removed at all from the ground coat, as were the coatings obtained in Comparative Example 4.

| Conversion Coating Solution: | |
|---|---|
| 75% $H_3PO_4$ | 10 g/l |
| $NaH_2PO_4$ | 3 g/l |
| $SnCl_2 . 2H_2O$ | 0.2 g/l |
| $NaClO_3$ | 7 g/l |
| pH 3.8 | adjusted by NaOH aqueous solution |
| Temperature of Solution: 65° C. | |

COMPARATIVE EXAMPLE 4

A comparative conversion coating solution was prepared from a known typical alkali phosphate conversion coating solution as shown below and subjected to conversion treatment in the same manner as in Example 4. The resulting coatings were tested for adhesion with a coating formed thereon. They exhibited good adhesion with the overcoat, none of the overcoat being removed therefrom.

| Comparative Conversion Coating Solution: | |
|---|---|
| $NaH_2PO_4$ | 7 g/l |
| $Na_2HPO_4$ | 5 g/l |
| NaF | 0.4 g/l |
| $NaClO_3$ | 5 g/l |
| pH 5.0 | adjusted by NaOH aqueous solution |
| Temperature of Solution: 70° C. | |

EXAMPLE 5

After being rinsed with a weak alkaline rinsing solution, tin-plated sheets SPTE#50 (JIS G 3303) (0.3×70×150 mm) were subjected to electrolysis conversion treatment under the conditions described below to form a coating which in turn was washed with water and dried. The treated sheets were tested by being sprayed with salt water for 24 hours (JIS-Z 2371), and the test showed that superior anti-corrosiveness, without any rust being produced.

A sheet which had previously been treated by electrolysis as above was placed in an electric furnace at 210° C. for 30 minutes in an air atmosphere. The test showed that no yellowing occurred, thus exhibiting superior resistance to oxidation.

| Conditions for Electrolysis Conversion Treatment | |
|---|---|
| Temperature of Solution: | 70° C. |
| Type of Electrolysis: | DC electrolysis |
| Electric current density: | 3 A/dm$^2$ |
| Duration electric current flow: | 4 seconds |
| Pole Ratio: | 1:1 |
| Distance between Electrodes: | 50 mm |
| Negative Electrode: | Tin-plated sheet (specimen) |

-continued

| Conditions for Electrolysis Conversion Treatment | |
|---|---|
| Positive Electrode: | carbon plate |

What is claimed is:

1. A conversion coating solution for treating metallic surfaces which has a pH value in the range of 3 to 6 and contains 1 g/l to 50 g/l of an acid alkali phosphate as phosphate ions, 0.2 g/l to 20 g/l of at least one chlorate and bromate, and 0.01 g/l to 0.5 g/l of tin ions, with a weight ratio of chlorine ions to tin ions being between 0.6 and 6.

2. A conversion coating solution as claimed in claim 1, wherein the acid alkali phosphate is selected from the group consisting of sodium, potassium and ammonium salts of phosphate and phosphoric acid neutralized with caustic alkali or aqueous ammonia.

3. A conversion coating solution as claimed in claim 1, wherein the acid alkali phosphate as phosphate ions is included in an amount of 5 to 25 g/l.

4. A conversion coating solution as claimed in claim 1, wherein tin ions and chlorine ions are present in the form of complex ions.

5. A conversion coating solution as claimed in claim 1, wherein a surfactant is further included.

6. A conversion coating solution as claimed in claim 1, wherein tin ions are present in the form of stannous chloride, stannic chloride, stannous sulfate or sodium stannate.

7. A conversion coating solution as claimed in claim 1, wherein chlorine ions are present in the form of a hydrochloric acid of alkali chlorine compound or tin chloride.

8. A conversion coating solution as claimed in claim 7, wherein the alkali chlorine compound is sodium chloride, potassium chloride or ammonium chloride.

9. A conversion coating solution as claimed in claim 8, wherein the acid alkali phosphate as phosphate ions is included in an amount of 5 to 25 g/l and the tin ions are present in the form of $SnCl_2$ or $SnSO_4$.

* * * * *